US005845569A

United States Patent [19]

Tkacz et al.

[11] Patent Number: 5,845,569

[45] Date of Patent: Dec. 8, 1998

[54] MULTI-TIERED SCREEN PRINTING MACHINE

[75] Inventors: Dariusz Tkacz, Naperville; Alex Iaccino, Mount Prospect, both of Ill.; Allen Mark Repashy, LaJolla, Calif.

[73] Assignee: M&R Printing Equipment, Glen Ellyn, Ill.

[21] Appl. No.: 957,975

[22] Filed: Oct. 21, 1997

[51] Int. Cl.[6] ..... B41F 15/04

[52] U.S. Cl. ..... 101/115; 101/126

[58] Field of Search ..... 101/114, 115, 101/116, 123, 126, 129

[56] References Cited

U.S. PATENT DOCUMENTS

| | | | |
|---|---|---|---|
| 83,912 | 11/1868 | Bradford . | |
| 422,060 | 2/1890 | Robinson . | |
| 4,606,268 | 8/1986 | Jaffa | 101/115 |
| 4,909,142 | 3/1990 | Bubley | 101/115 |
| 4,974,508 | 12/1990 | Anderson | 101/115 |
| 5,020,430 | 6/1991 | Harpold et al. | 101/126 |
| 5,127,321 | 7/1992 | Proffer | 101/115 |
| 5,129,155 | 7/1992 | Hoffman et al. . | |
| 5,154,119 | 10/1992 | Fugua et al. | 101/115 |
| 5,161,460 | 11/1992 | Anderson et al. | 101/116 |
| 5,195,434 | 3/1993 | Hoffman . | |
| 5,239,613 | 8/1993 | Motev et al. | 101/115 |
| 5,383,400 | 1/1995 | Szyszko . | |
| 5,595,113 | 1/1997 | Daniel et al. . | |
| 5,613,436 | 3/1997 | Taylor | 101/115 |
| 5,626,074 | 5/1997 | Zelko | 101/115 |
| 5,664,495 | 9/1997 | Winter . | |

OTHER PUBLICATIONS

"10–Color Capability Servo–Driven Indexer User–Friendly Controls" Gauntlet Series II advertising brochure.

"Challenger Textile Screen Printing System" advertising brochure.

"Champrint Automatic Textile Painter" 2 Page Sales Brochure, Oct. 3, 1990 or Advanced American Equipment 101/115 From GEO Advance Group, Chicago, Illinois.

*Primary Examiner*—Eugene Eickholt

*Attorney, Agent, or Firm*—Wallenstein & Wagner, Ltd.

[57] ABSTRACT

A turret style printing machine (10) includes a first tier (16) of pallet supporting members (14), a second tier (20) of printing head supporting members (18) and a third tier (24) of printing head supporting members (22). One can thus selectively move either a second tier member (18) or a third tier member (22) into alignment and registration with a first tier member (14). A uniform registration is further provided ensuring the second third tier supporting members consistently align with the first tier supporting members (14). This expansion increasing the number of stations is accomplished without necessarily increasing the required floor space or system diameter.

32 Claims, 7 Drawing Sheets

MULTI-TIERED SCREEN PRINTING MACHINE

TECHNICAL FIELD

The present invention relates generally to printing machines and, more particularly, to turret or carrousel style screen printing machines having multiple arm assemblies tiered above one another for permitting more arms to be available for the printing process.

BACKGROUND OF PRIOR ART

Indicia applied permanently to articles of clothing and other textiles have become very popular. Fanciful indicia, such as logos, slogans, college names, sports team names and sayings, are now commonplace. As a result, screen printing has become very popular. Large, commercial operations screen printing textiles are common today.

Indicia can be one or more colors. Typically, a screen printing machine has at least one station for each color employed. For example, a design incorporating two colors will have at least two printing stations, one for each color. A design employing eight colors will have at least eight stations. Each station generally includes a printing head, which supports a single screen, the ink to be used at that particular station and a mechanism for applying the ink to the textile. Each color is carried by a single screen. The textile to be screened travels from printing station to printing station by one of a number of methods, such as a chain or a rigid arm. The textile is usually carried by a metal pallet, pallet support, flat bed, or platen. Common printing machines include turret, oval and linear type machines. In addition to printing stations, there may also be curing stations to heat and set the inks placed on the textile or substrate.

In both the linear and oval style printing machines, the pallet carrying the textile to be printed upon travels via a chain on a track or rail from station to station. In the turret or carrousel style printing machine, a center section has a plurality of spider arms. Generally, there are two levels of spider arms, namely, an upper level carrying the printing heads and screens or the curing assemblies, and a lower level carrying the pallet with the textile to be printed upon. Either the lower pallet/textile arms rotate with respect to the printing/curing arms or the printing/curing arms rotate relative to the pallet/textile arms. The stationary arms are commonly referred to as "stations."

The travelling arm moves from station to station. Specifically, each moving arm is indexed and registered at a station, the station's function, be it printing or curing, is performed and the arm moves to the next station.

For clarity, the discussion following will focus on one configuration, that being moveable lower arms supporting the pallets and textiles and stationary upper arms supporting printing heads or curing units, with the lower arms. It is appreciated this configuration can be different, e.g., stationary printing/curing arms and travelling pallet/textile stations. The teachings of this disclosure work well in any of the configurations.

Highly successful machines of this type just noted are manufactured and sold by M&R PRINTING EQUIPMENT, INC. ("M&R"), Glen Ellyn, Ill. One such machine is a manual machine. One or more operators move the lower pallets relative the printing heads and physically move the printing heads to the pallet where the heads are registered (aligned). Once registered, the paint is squeegeed over the screen and imprinted on the textile upon the pallet. The printing head is then physically lifted and the next pallet rotated into the position of the preceding pallet. Each operator can cover one or more printing heads or stations. Accordingly, an eight (8) station system may have two operators, each working with four (4) printing heads. Or, as is commonly the practice, an eight (8) station system may have two operators, each working with four (4) stations, three (3) having printing heads and one (1) being the loading or unloading pallet for placing or removing the textiles onto or off of the pallets.

Unfortunately, one drawback of this and other similar machines is the size. The diameter across the assembled machine can be quite large, taking up significant shop floor space. As the number of stations increase, the diameter of the system increases.

The present invention involves another technique for increasing the number of stations without necessarily increasing the required floor space or system diameter. Accordingly, for a machine with a set number of printing stations, additional printing stations can be added to the machine and used. For the embodiment(s) discussed below, a machine with N printing stations and N pallets for supporting the object to be printed upon, can be expanded with the original N pallets to have (N−1)[lower tier]+N [upper tier] printing stations. The advancement discussed herein resulted from a redesign of the machine to permit flexibility as to the number of print stations, without affecting the ease of use and the strength of the machine. In addition, the developed feature can be retrofitted on to machines designed to work with or without the upper tier, thus avoiding the need to purchase a new machine.

SUMMARY OF THE INVENTION

According to a first aspect of the invention, an apparatus and method are disclosed for incorporating at least one additional tier to a turret style printing machine. The printing machine includes a centrally located turret, or base section, a first tier of pallet supporting members, each supporting a pallet, a second tier of printing head supporting members, the second tier above the first tier, and a third tier of printing head supporting members, the third tier above the second tier. Generally, the second tier printing head supporting members and the third tier printing head supporting members support printing heads. Each first tier supporting member is connected at one end to a rotatable lower collar and at the other, distal end to a pallet. Each second tier supporting member is connected at one end to a rotatable upper collar and at the other, distal end to a printing head. Each third tier supporting member is connected at one end to a rotatable auxiliary collar an at the other, distal end to a printing head. The lower collar, the upper collar, and the auxiliary collar are each rotatably mounted to the base section for permitting all of the tiers of supporting members to independently rotate about the base section.

According to another aspect of the present invention, means are provided for selectively bringing either a second tier printing head or a third tier printing head toward a pallet. Both the printing head supporting arms and the auxiliary printing head supporting arms are moveable in at least two radial planes, the two planes being normal to one another. The two planes include: 1) a horizontal plane about the base section wherein each arm rotates about the rotatable collar connected to the arm; and, 2) a vertical plane about the base section by a hinge disposed on the arm between the distal end and the base end of the arm. By rotating the supporting member about the hinge, the supporting member is moveable towards the pallet supporting member.

According to yet another aspect of the invention, each first tier pallet supporting member has a first registration assembly associated therewith. Each second and third tier printing head supporting member has a second registration assembly associated therewith. The first and second registration assemblies cooperate with one another when a printing head is selectively brought into very close proximity with a pallet for printing.

Through manipulation of the second tier printing head supporting member, including operation of the registration assemblies, a second tier printing head can be aligned with the pallet supporting arms to permit a printing head to cooperate with a substrate resting on a pallet. Additionally, a third tier printing head is able to cooperate with the same substrate resting on the pallet. This results through aligning the auxiliary printing head supporting arm with a pallet supporting arm and rotating the auxiliary printing head supporting arm substantially vertically between the printing head supporting arms to the pallet attached to the pallet supporting arm.

With any turret style printing machine there are typically N equally spaced apart pallet supporting arms. With the present multi-tiered printing machine there are generally N−1 second tier printing head supporting arms and a gap, the gap together with the printing head supporting arms being equally spaced apart. There are also N auxiliary printing head supporting arms. This allows for 2N−1 different printing head supporting arms, each capable of supporting a printing head. Other configurations can also be constructed by varying either/and the spacing between the arms and/or the overall diameter of the machine. Moreover, if desired, curing stations can be employed in lieu of printing heads.

Other advantages and aspects of the present invention will become apparent upon reading the following description of the drawings and the detailed description of the invention.

BRIEF DESCRIPTION OF DRAWINGS

To understand the present invention, it will now be described by way of example, with reference to the accompanying drawings in which.

DETAILED DESCRIPTION

Figure 1:
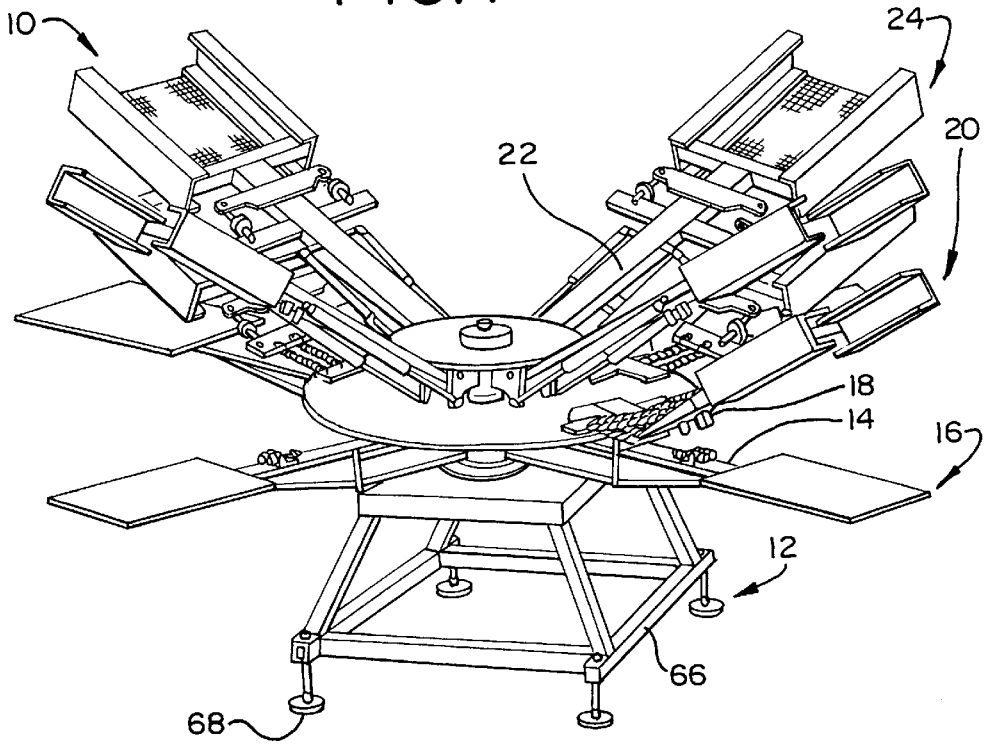
FIG. 1 is a front perspective view of one embodiment of the multi-tiered printing press of the present invention.

While this invention is susceptible of embodiment in many different forms, there is shown in the drawings and will herein be described in detail preferred embodiments of the invention with the understanding the present disclosure is to be considered as an exemplification of the principles of the invention and is not intended to limit the broad aspects of the invention to the embodiments illustrated.

The Overall Machine 10

Figure 2:
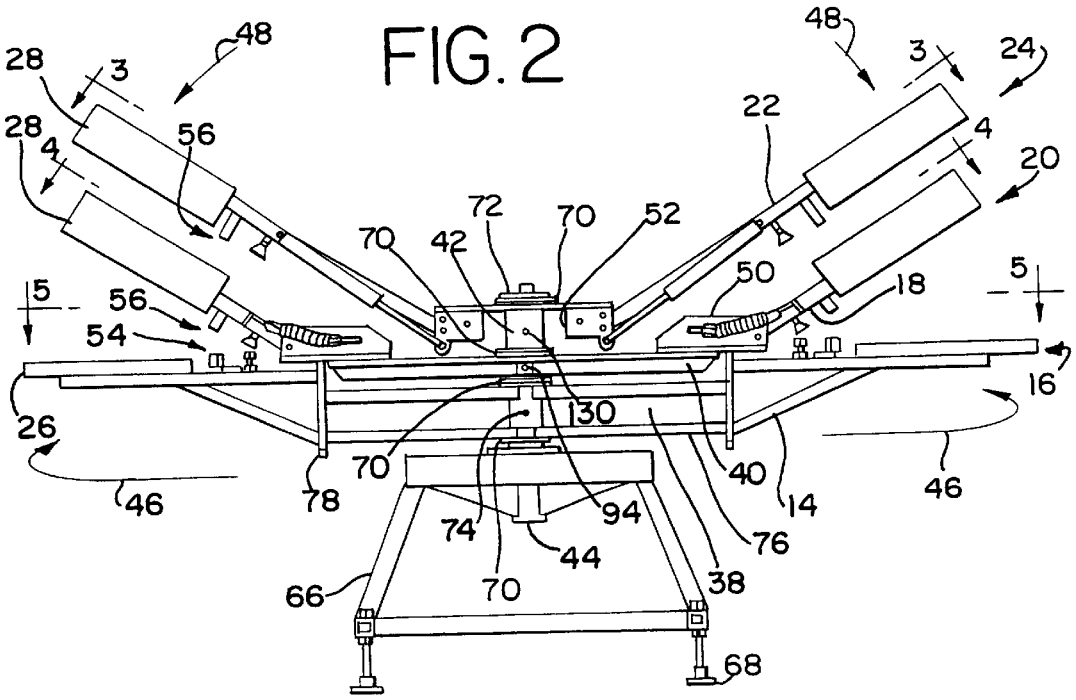
FIG. 2 is the front elevation view of the multi-tiered printing press of FIG. 1.

Referring to the Figures and specifically FIGS. 1 and 2, a multi-tiered turret style printing machine 10 is shown having a centrally located turret 12, or base section, that is stationary when in use. This base section 12 can include wheels to move it to different locations for use thereof. The base section 12 supports a plurality of radially spaced apart pallet supporting arms 14 (forming the first tier 16), radially spaced apart printing head supporting arms 18 (forming the second tier 20), and radially spaced apart auxiliary printing head supporting arms 22 (forming the third or auxiliary tier 24). The third tier 24 is positioned above the second tier 20, while the second tier 20 is positioned above the first tier 16. In general, each of the supporting arms 14,18,22 spoke radially outwardly from the base section 12.

The printing machine 10 of FIG. 1 includes four pallet supporting arms 14 with each supporting a pallet 26, three printing head supporting arms 18 with each supporting a printing head 28, and four auxiliary printing head supporting arms 22 with each supporting a printing head 28. While the discussion herein focuses for convenience and clarity on a first tier of pallet supporting members 14 and pallets 26 for supporting the item to be printed upon, e.g., textile or transfer, and on second and third tiers of printing head supporting members 18,22 for supporting the screen, printing mechanism and paint, this need not be the case. The second tier supporting arms 18 and the third tier supporting arms 22 can support curing units (not shown), or other accessories. Additionally, and again for clarity, while not shown, it is understood the specific movement of each tier 16,20,24 described herein can include that of any tier described.

In addition, it should be further understood the present invention can include more or less than four supporting arms per tier. Preferably, there are four to eight first tier pallet supporting arms 14, four to eight third tier auxiliary printing head supporting arms 22, and three to seven second tier printing head supporting arms 18. Additionally, the second tier 20 has a gap 30 (see FIG. 4) in place of one of the printing head support arms 18. Consequently, a standard machine having eight equally spaced pallet supporting arms 14 would have seven second tier printing support arms 18 and a gap 30, or nothing, in the location where the eighth printing support arm would normally be located. A typical machine having six pallets and six printing heads could be expanded to eleven printing heads. Accordingly, in a machine generically designed normally for N pallet supporting arms 14 and a single tier of N printing head supporting arms 18, the modified machine of the present invention 10 would include: N first tier pallet supporting arms 14, N−1 second tier printing head supporting arms 18 and N third tier printing head supporting arms 22. The second tier 20 has N−1 supporting arms 18 to accommodate a space or gap 30 to permit any third tier supporting arm 22 to rotate through the second tier gap 30 to contact the first tier supporting arm 14. In short, it is preferred for there to be at least one gap 30 in the second tier 20 to allow room for a third tier supporting arm 22 to be lowered towards and cooperate with the first tier supporting arm 14. Thus, a standard machine having eight printing heads or stations can be expanded to fifteen printing stations; a standard machine of six printing stations can be expanded to eleven printing stations. In the illustrated example of the figures, a four station machine is augmented to a seven station machine having four pallets 26 (first tier 16), and seven print heads 28 (three printing heads in the second tier 20 and four printing heads in the third tier 24). See FIG. 1.

While not shown in the figures, at times it may be desired to have a gap 30 in the third tier of printing head support arms 22. As discussed above, and shown in the figures identifying the second tier 20, the reasons for a gap 30 in the third tier 24 is to provide maneuverability room for the raising and lowering of a second tier supporting arm 18.

The printing machine 10 also incorporates a means for selectively bringing either a second tier printing head supporting member 18 or a third tier printing head supporting member 22 towards a pallet supporting member 14. As such, the printing head supporting arms of the second tier 18 are adapted for movement relative to the pallet supporting arms 14 for alignment therewith. This permits a screen 58 secured to a printing head 28, attached generally to a distal end 32 of at least one printing head supporting arm of the second tier 18, to cooperate with a substrate resting on a pallet 26, attached generally to a distal end 34 of the pallet supporting arm 14 (first tier). Similarly, the printing head supporting arms of the auxiliary or third tier 22 are adapted for movement relative to the pallet supporting arms 14 for alignment therewith. This permits a screen 58 or a curing head secured to a printing head 28, attached generally to a distal end 52 of at least one printing head supporting arm of the third tier 22, to cooperate with a substrate resting on a pallet 26 attached generally to a distal end 32 of the pallet supporting arm (first tier). Thus, a textile on a pallet 26 can be printed upon by movement (rotation), alignment, and registration (discussed below) of each of the printing heads 28 from both tiers 20,24 without the need for moving the pallet 26.

Each supporting arm 14,18,22 is connected to the base section 12 by means of a rotatable collar 38,40,42 attached to a vertical shaft 44 of the base section 12. See FIGS. 2–5. The first tier of pallet supporting arms/members 14 is connected at one end to a rotatable lower collar 38 and optionally connected at or proximate the other, distal end 34 to a pallet 26. The second tier of printing head supporting arms/members 18 is connected at one end to a rotatable upper collar 40 and optionally connected at or proximate the other, distal end 32 to a printing head 28. Similarly, the third, or auxiliary, tier of printing head supporting arms/members 22 is connected at one end to a rotatable auxiliary collar 42 and optionally connected at or proximate the other, distal end 52 to a printing head 28. The lower collar 38, the upper collar 40, and the auxiliary collar 42 are each rotatably mounted to the base section 12 for permitting all of the tiers 16,20,24 to separately rotate about and relative to the base section 12. In short, each tier 16,20,24 rotates independently via its collar 38,40,42 relative to the other tiers 16,20,24 and the base section 12. Nevertheless, any one of the tiers 16,20,24 may be fixed in position relative to the base 12, with the other tiers 16,20,24 rotating around both that particular tier and the base section 12.

Figure 9:
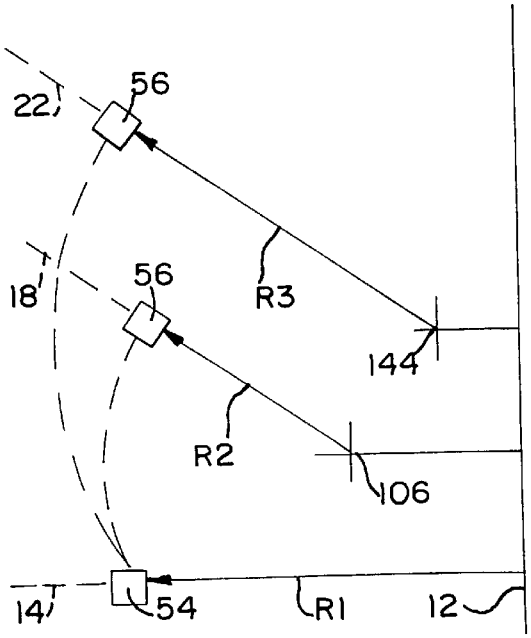
FIG. 9 is schematic view of the first and second registration assemblies; and, FIGS. 10*a*–10*g* are schematic views of one methodology of the multi-tiered printing press.

As described in the above-mentioned movements, both the printing head supporting arms 18 and the auxiliary printing head supporting arms 22 are moveable in at least two radial planes 46,48 each plane normal to one another. The two planes (shown as arrows 46,48 in FIGS. 2 and 9) in which the printing head supporting arms 18,22 are moveable include: (1) a horizontal plane 46 about the base section (see FIG. 2); and, (2) a vertical plane 48 about the base section (see FIG. 9). The arms 18,22 are moveable in a horizontal plane 46 by the rotatable collar 40,42 connected to each arm 18,22. And, the arms 18,22 are moveable in a vertical plane 48 by a hinge assembly 50,52 disposed on the arm 18,22.

Figure 6:
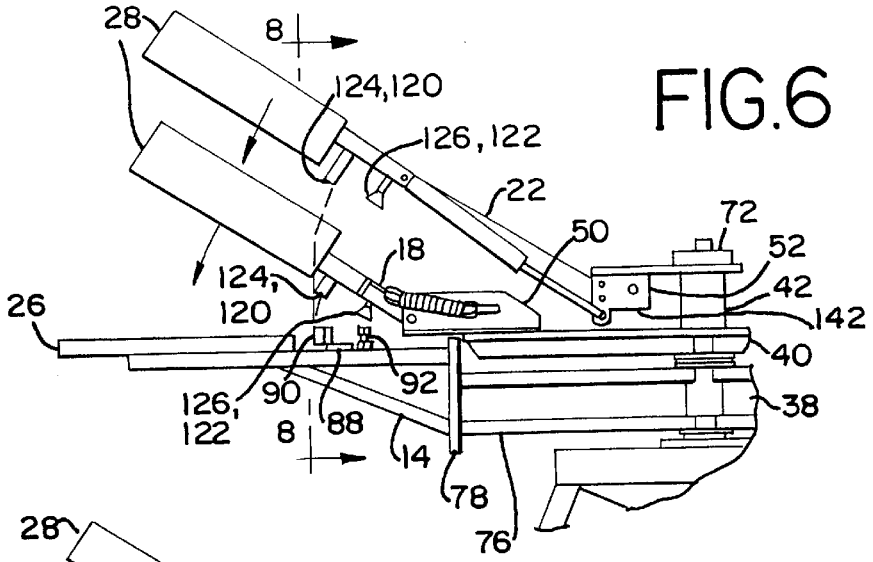
FIG. 6 is partial side elevation view of the first tier of the pallet supporting members and the second and third tiers of the printing head supporting members, including the first and second registration assemblies associated therewith.
Figure 8:
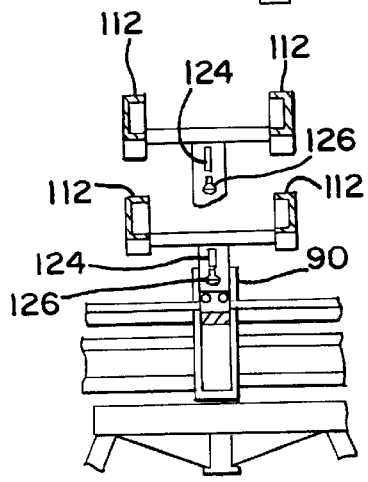
FIG. 8 is a partial front elevation view of the tiers shown in FIG. 6.

Additionally, as shown in FIGS. 6 and 8, each first tier pallet supporting member 14 has a first registration assembly 54 associated therewith and each second and third tier printing head supporting members 18,22 has a second registration assembly 56 associated therewith. The first and second registration assemblies 54,56 cooperate with one another when a printing head 28 is brought very close to a pallet 26. By first horizontally aligning a printing head supporting arm 18,22 to a pallet supporting arm 14, a printing head 28 attached to a printing head supporting arm can be moved vertically to cooperate with a substrate resting on a pallet 26 attached to the pallet supporting arm.

The distal ends 32,52 of the two tiers (second and third tiers) of the printing head supporting members support printing heads 28. A typical printing head 28 includes well known and conventional components such as a screen 58 supported by opposed arms 60, a flood bar (not shown) and a squeegee 62. By automatic or manual means the flood bar and squeegee 62 of a print station operate to print an image, in a single color, on the substrate resting upon the pallet 26. The distal ends 34 of the pallet supporting members support metal pallets 26, flat beds, or platens for carrying the textile or substrate (not shown) to be printed upon. As noted above, the printing head arms 18,22 can support conventional, well-known curing units (not shown), as opposed to printing heads 28.

Figure 10A:
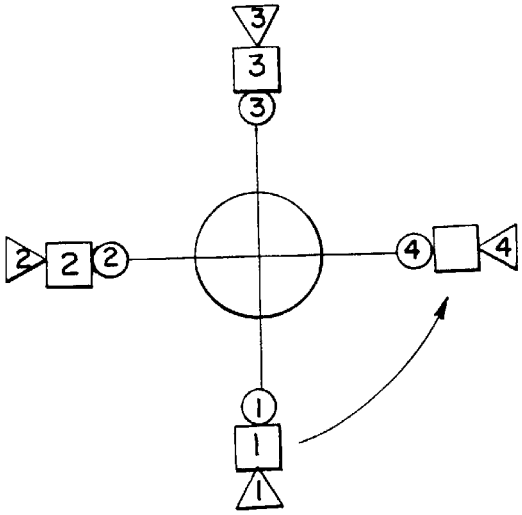
Figure 10B:
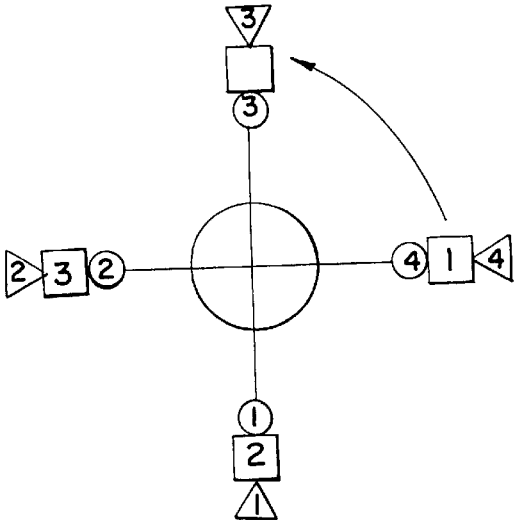
Figure 10C:
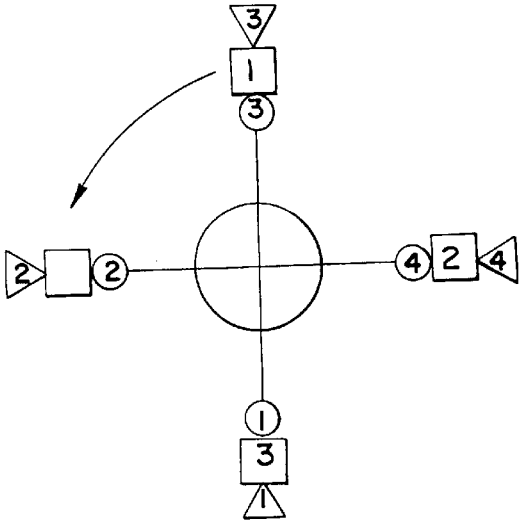

In operation, each pallet 26 generally operates as a focal station 64. Four such focal stations 64 are shown in schematic FIGS. 10*a*–10*g*. As identified in FIG. 10, a circle designates a first tier pallet 26, a square designates a second tier printing head 28, a blackened in square represents a second tier gap 30, and a triangle represents a third tier printing head 28. Each pallet 26 contains a substrate (not shown) thereon, and each printing head 28 contains a single screen 58 and a single color of ink. To apply a single color to the substrate, either a second or third tier supporting arm 18,22 supporting a printing head 28 is manually or mechanically/automatically rotated to horizontal alignment with the pallet 26 (see FIG. 10*a*). Then, the printing head 28 and support arm 18,22 are brought vertically downward toward the substrate on the pallet 26. Once the support arm 18,22 is registered, the printing head 28 is brought in contact with the substrate and the ink squeegeed through the printing screen 58 onto the substrate. Specifically, the printing head 28 is brought parallel and just above the pallet 26. Thus, when a squeegee is passed over a screen 58, the screen 58 contacts, or is just a slight distance from the textile.

Figure 10D:
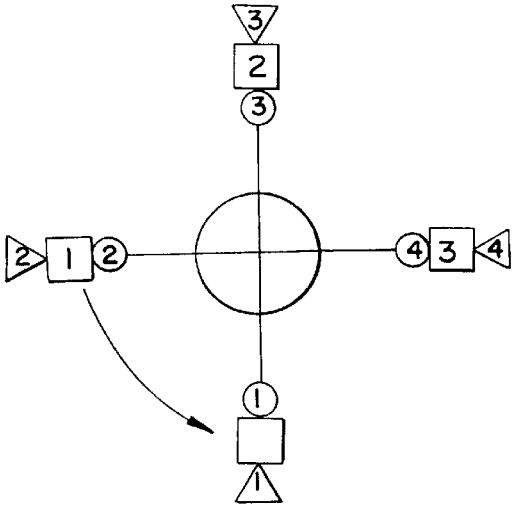
Figure 10E:
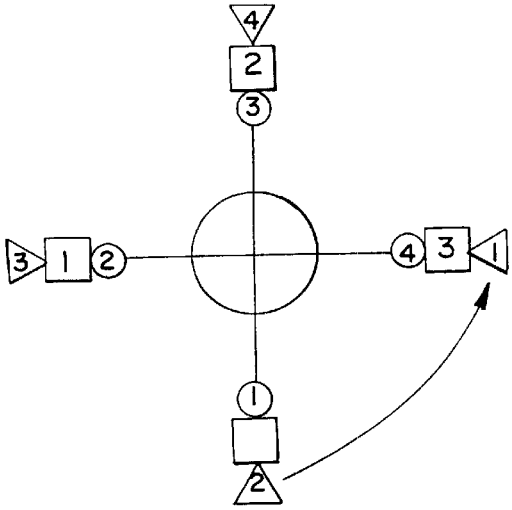
Figure 10F:
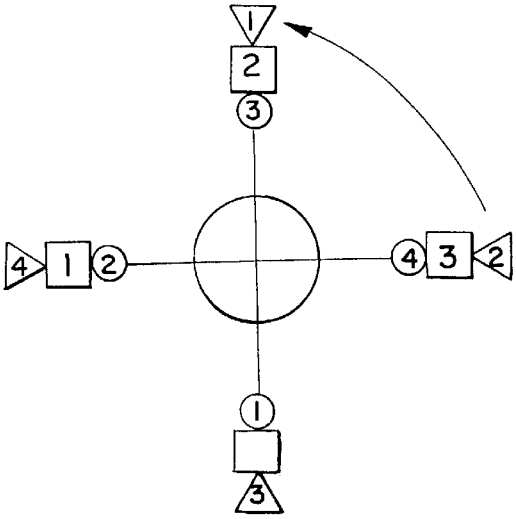
Figure 10G:
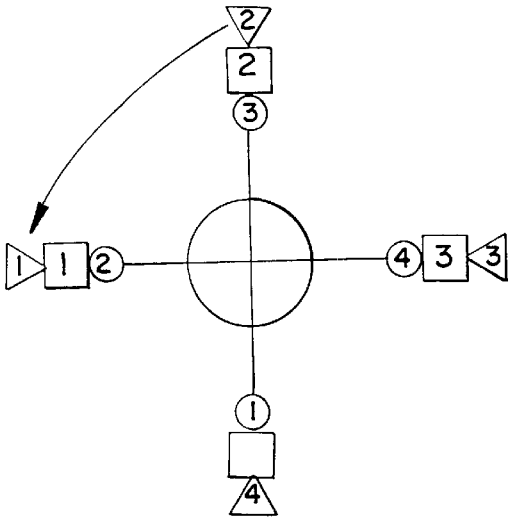

Next, any one of a number of process steps can be pursued. For example, the second tier printing head supporting members 18 can be rotated (horizontally) such that a different second tier printing head 28 is aligned with the pallet supporting member 14, registered with the pallet 26, and ultimately screen printed onto the substrate (see FIG. 10*b*). This process can be repeated (FIG. 10*c*) for each second tier printing head 28 until each head has printed on the substrate. Then, the gap 30 of the second tier 20 is rotated in-line relative to the pallet 26 (FIG. 10*d*). Next, a third tier printing head supporting arm 22 is rotated (horizontally) to a align the third tier arm 22 with the pallet supporting member 14. The printing head 28 is brought vertically downward, through the gap 30, and toward the substrate wherein it is registered by the registration system 54,56. Finally, at registration, the printing head 28 is very close to the substrate and the ink is squeegeed through the printing screen 58 onto the substrate. The third tier printing head support arm 22 is then raised back upward, the third tier 24 rotated, and the next third tier arm 22 brought into position (FIG. 10*e*). Once all of the third tier printing head support arms 22 have been utilized (FIGS. 10*f*–10*g*) the process begins again with a different focal station 64 by rotating the first tier arm 14 into place.

As noted, this printing process can be performed several different ways. The first tier support arms 14 can be rotated such that each substrate on a different first tier support arm 14 is printed upon with a single printing head 26 (either second or third tier). Then, the first tier arms 14 can be rotated such that each substrate is printed upon by the next, adjacent printing head 26. This procedure can be continued until each substrate has been printed upon by every printing head 26 in a single tier 20 or 24.

Generally, the first tier of pallet support arms 14 remains stationary and the second and third tiers of printing head support arms 18,22 rotate into alignment and then into registration with the pallet supporting arms 14. As described above, the first tier pallet support members 14 may also be rotated. Regardless of where the pallet support arm 14 is located, every printing head support arm 18,22 can be aligned and registered with each pallet 26 during the printing process.

The Base Section 12

The base section 12 includes, among other things, a frame 66 having supporting pads 68, and a means for supporting the collars 38,40,42. As shown in FIG. 1, the frame 66 is constructed of a steel truss system. Supporting pads 68 are located at several of the lower proximities of the frame 66 for support and stable operation. The pads 68 include a threaded-rod portion which enables an operator to raise and lower the machine and to level the machine on a shop floor.

Preferably, the means for supporting the collars 38,40,42 includes a centrally disposed vertical main shaft 44 connected to the frame 66 via one or more bearings/bushings (not shown). The main shaft 44 extends vertically upward from the base section 12. Each of the collars 38,40,42 supporting a tier of support arms 14,18,22 is connected, in series, one on top of another, to the outer diameter of the main shaft 44. Each collar 38,40,42 is connected by conventional bearing means (not shown) to the main shaft 44. As previously described, this construction allows each tier 16,20,24 to independently rotate about the base section 12.

Additionally, a bushing or thrust bearing 70 is placed between the collars 38,40,42 and between the lower collar 38 and the base section 12. The bushing 70 operates as a frictionless surface between the collars 38,40,42 such that the collars 38,40,42 do not contact each other and can rotate independently. Alternatively, the main shaft 44 may contain stepped shoulders (not shown) having different outside diameters to individually support and maintain a gap between the various collars 38,40,42 themselves and between the base section 12. With this configuration, each collar 38,40,42 rests against a separate shoulder.

The base section 12 also includes a cap 72, as shown in FIGS. 1 and 2. The cap 72 operates as a cover and is positioned over the top of the main shaft 44. As such, the bottom of the cap's side wall is positioned on top of the auxiliary collar 42. More specifically, the bottom of the cap's side wall rests on top of the bushing 70 positioned on the top surface of the auxiliary collar 42. Generally, the cap 72 is bolted to the main shaft 44. Additionally, a modified cap (not shown) may be utilized if the auxiliary tier 24, including the auxiliary collar 42, is removed from the overall machine 10. The modified cap has elongated side walls so the bottom of the sidewalls is positioned on top of the upper or second collar 40, and more specifically, resting on the top surface of a thrust bearing 70 positioned above the upper collar 40.

The First Tier 16

The first tier of pallet supporting arms 14 is the lowermost tier of radially spoking supporting members and is generally directly above the base section 12 (FIGS. 1 and 2). The first tier 16 contains four primary components: (1) a rotatable lower or first collar 38; (2) a supporting member 14; (3) a first registration system 54; and, (4) an accessory, here a pallet 26. See FIG. 5. The lower or first collar 38 and supporting member 14 are load bearing components. Therefore, these components are generally made of high strength materials, including steel. However, aluminum or other materials may be used.

Figure 5:
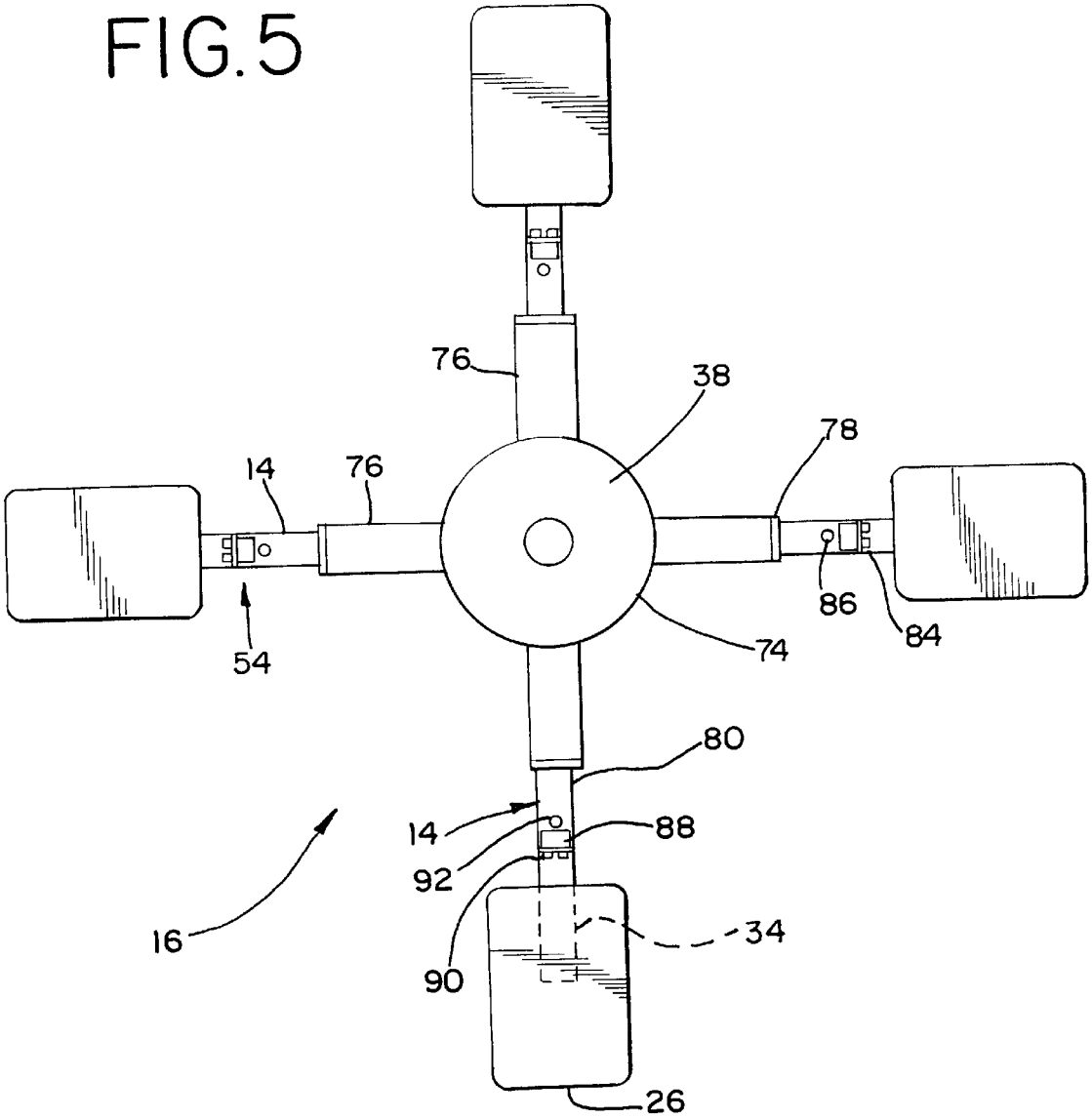
FIG. 5 is a top plan view along line 5—5 of FIG. 2, showing the first tier of the pallet supporting members.

As shown in FIG. 5, the rotatable lower or first collar 38 includes a circular ring 74 and four equally spaced spokes 76 or protrusions extending from the circular ring 74. In the larger embodiment, the lower collar 38 includes eight equally spaced spokes 76. With eight equally spaced spokes 76, a spoke is situated approximately every 45°, or at 45° intervals. The circular ring 74 generally has an inner diameter and outer diameter. The inner diameter of the ring contains bearing elements (not shown) which cooperate with the vertical shaft 44. The bearing elements allow the lower collar 38 to independently rotate about the vertical shaft 44 and the base section 12. For placement of the lower collar 38 on the vertical shaft 44, a bushing or thrust bearing 70 is first fitted on the shaft 44 and positioned on the top surface of the base section 12. Then, the lower collar 38, with bearing elements in place, is fit onto the vertical 44 shaft by standard processes. As such, the bushing 70 remains between the lower collar 38 and the base section 12. As previously described, instead of, or in conjunction with the bushing 70, the vertical shaft 44 may be machined with multiple shoulders for seating the various collars 38,40,42 of the overall machine 10.

Spokes 76 extend radially from, and are fixed (via welding) to the outer diameter of the ring 74 at equally spaced intervals. The spokes 76 are support elements having a splice plate 78 located at their respective distal or furthest, radially outward point. The pallet support members 14 are connected to the lower collar 38 at the splice plate 78. Thus, the supporting arms 14 extend radially outward from the base section.

The first tier 16 shown includes four pallet supporting members 14, also shown in FIG. 5. In general, the first tier supporting member 14 has two ends, a proximal 80, inner, or base end, and a distal 34, outer end. The proximal end 80 of the supporting member (shown in FIGS. 1 and 3) is removably located on and connected to the rotatable lower collar 38 at the splice place 78. The supporting members 14 can be easily located on, and connected to the splice plate 78 by use of bolts, screws, pins or other acceptable means. The other, distal end 34 of the supporting member allows for an accessory 26 to attach to the supporting member 14. In the preferred embodiment the accessory employed is a conventional pallet 26. The accessory is attached to the top surface of the supporting member 14 by clamps, bolts, cams, or other fixing and locking means.

Figure 7:
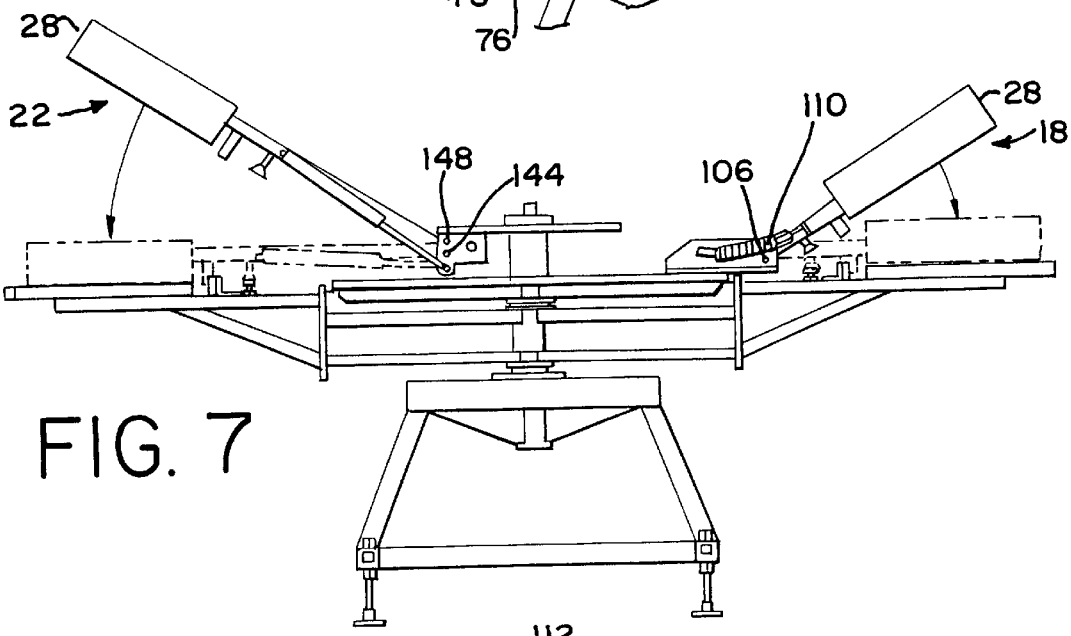
FIG. 7 is a partial side elevation view of the rotation in the vertical plane of the second and third tiers of the printing head supporting members.

Also, as shown in FIGS. 5–7, each first tier supporting member 14 has a first registration system 54 located on the top surface of the first tier supporting member 14. The overall first registration assembly 54 includes horizontal 84 and vertical registration mechanisms 86. The horizontal registration mechanism 84 includes: (1) an L-shaped bracket 88 fixed to the supporting member 14; and, (2) rollers, spacers, cam followers or a V-block 90. The L-shaped bracket 88 is fixed to the supporting member 14 such that the vertical portion of the L-shaped bracket 88 faces the pallet 26 and the horizontal portion of the L-shaped bracket 88 rests on the supporting member 14 and extends away from the pallet 26 and towards the center of the base section 12. Two rollers or spacers 90 extend horizontally away from the vertical portion of the L-shaped bracket 88 in the opposite direction as the horizontal portion. The rollers 90 are positioned side-by-side, with a gap between the rollers 90. The vertical registration mechanism 86 of the first registration system 54 includes a positioning stop 92. The stop 92 can be adjusted to raise or lower the registration point relative to the first tier supporting member. The first registration system 54 cooperates with a second registration system 56 located on both the second and third tier supporting arms 18,22. Together the first and second registration systems 54,56 align a printing head supporting arm 18,22 substantially horizontally and vertically in relation to a pallet 26 attached to the pallet supporting arm 14. This allows each printing head 28 attached to all printing head supporting arms 18,22 to be perfectly aligned with the substrate resting on a pallet 26 during the printing process.

The Second Tier 20

The second tier of support arms 18 is the second tier of radially spoking arms above the base section 12, and the middle tier of radial arms shown in FIGS. 1 and 2. Similar to the first tier 16, the second tier 20 contains four primary components: (1) a rotatable upper or second collar 40; (2) a supporting member 18; (3) a second registration system 56; and, (4) an accessory, here a printing head 28. See FIG. 4. The upper or second collar 40 and second tier supporting members 18 are load bearing members. As such, these members are generally made of high strength materials including steel, aluminum, or any other acceptable material having similar qualities.

Figure 4:
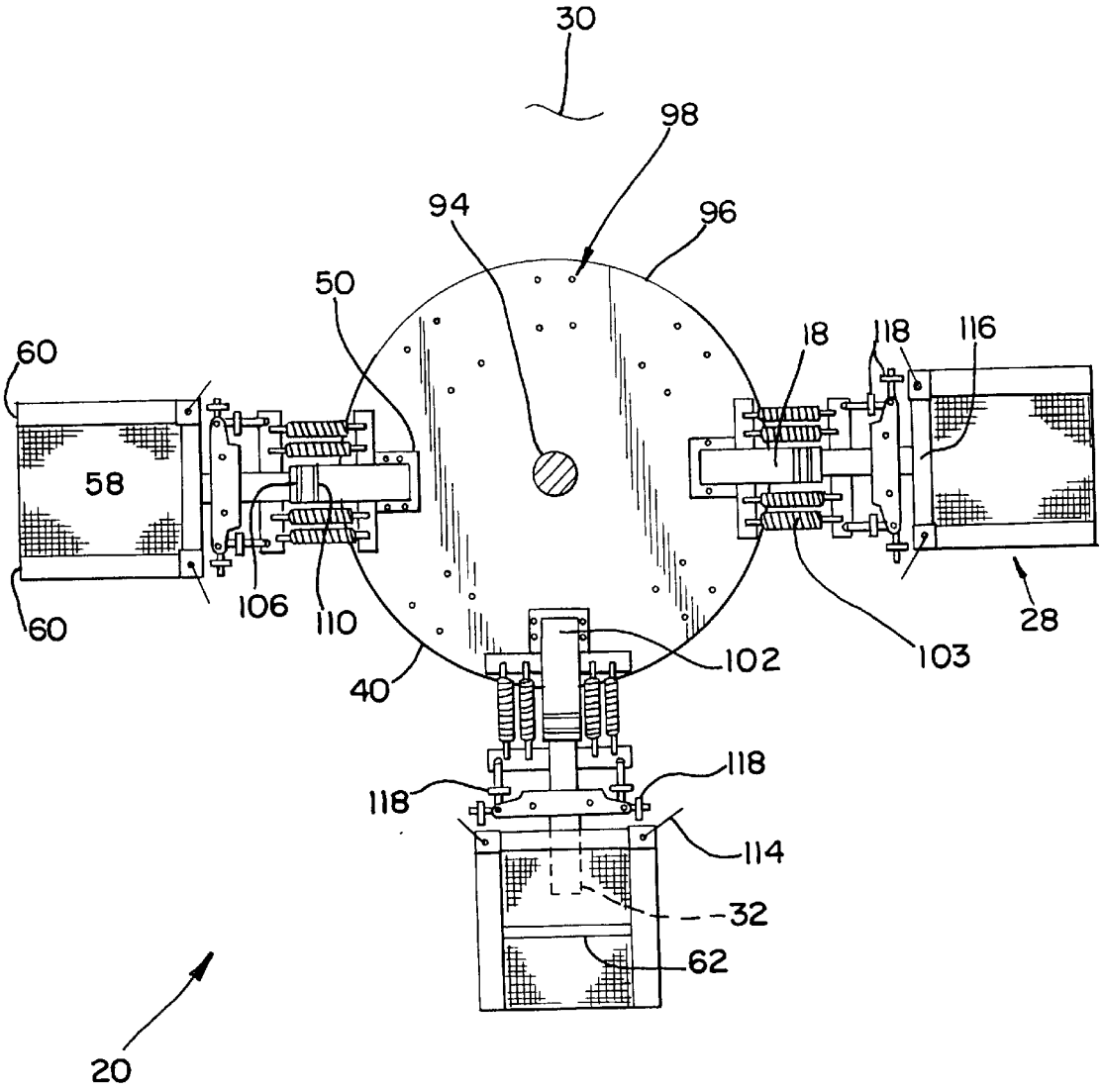
FIG. 4 is a top plan view along line 4—4 of FIG. 2, showing the second tier of printing head supporting members.

As shown in FIG. 4, the rotatable upper or second collar 40 includes a ring 94 and a circular plate 96. The ring 94 of the upper collar generally has an inner diameter and outer diameter. The inner diameter of the ring 94 contains bearing elements (not shown) which mate with the main shaft. The bearing elements allow the upper collar 40 to independently rotate about the main shaft 44, the base section 12 and the other tiers 16,24. For placement of the upper collar 40 on the main shaft 44 a bushing or thrust bearing 70 is fitted on the shaft 44 and positioned on the top surface of the lower collar 38. Next, the upper collar 40, with radial bearing elements in place, is fit onto the main shaft 44 by standard processes. As such, the bushing 70 remains between the upper collar 40 and the lower collar 38. The bushing 70 acts as a frictionless surface and allows each collar to rotate independently and without contacting each other. As described above, instead of, or in conjunction with the bushing 70, the main shaft 44 may be machined with multiple shoulders for seating some or all of the collars/tiers of the overall machine.

Similar to the spokes 76 of the lower collar, the plate 96 of the upper collar extends radially outward from the ring 94. The plate 96 includes a series of equally spaced bolt hole patterns 98 about the edge of the plate 96. In the preferred embodiment, shown in FIG. 4, there are eight equally spaced bolt hole patterns 98, each pattern being centered every 45° proximate the edge of the plate.

The second tier support member 18 is attached to the upper collar 40 through a bracket 50 at the first end, or base end 102, of the support member, with the bracket 50 being connected to the top surface of the plate 96. The bracket 50 extends from the first end 102 of the second tier support member and contains a mating bolt hole pattern 98 to those on the plate 96. Thus, the bracket portion 50 of the support member 18 can be bolted to the top surface of the plate 96 at one of the plate's bolt hole patterns 98. As shown in FIG. 4, three equally spaced support members 18 are attached to top surface of the plate 96. Generally, the second tier 20 is comprised of one less supporting member than both the first 16 and third tiers 24. This is required for there to be an equally spaced gap 30 in the second tier 20.

The second tier 20 also includes means for selectively bringing a second tier printing head supporting member 18 toward a pallet supporting member 14. One means includes the bracket 50 of the supporting member 14 having a hinge or pivoting pin 106, whereby the pin 106 rotatably retains the supporting member 18. As such, the supporting member 18 is hingedly connected to the collar 40. In addition to the bracket 50 including a pivoting pin 106, the bracket 50 includes a series of springs 108 which are also connected to the supporting member 18. In the embodiment shown, four tension springs 108 assist the user in more easily raising and lowering the printing head support arm 18. As shown in FIGS. 6 and 8, the support member 18 vertically rotates about the pin 106 relative to first tier supporting arms 14, between a raised position and a lowered position. In the raised position a stop 110 in the bracket 50 prevents the supporting arm 18 from being rotated any further upward than shown in FIGS. 1, 4, 6 and 7. In the lowest rotation position, the printing head 28 connected to the second tier printing head supporting member 18 is able to contact a substrate on a pallet 26 of the first tier 16. Screen printing takes place at this lower point.

As shown in FIG. 4, the distal end 32 of the support member has a U-shaped arm system which ultimately supports an accessory. The U-shaped arm system consists of two lateral L-bars or U-bars 60 connected to horizontal member 116. A slidable clamp 114 connecting each U-bar 60 to the horizontal member 116 allows each U-bar to be independently moved in and out from the centerline of the supporting arm 18. Additionally, a series of adjustors 118 manipulate the overall U-shaped arm system relative to the supporting arm 18 in order to correctly align the U-shaped arm system and an inserted accessory with a mating substrate. Another mode of supporting an accessory includes an end clamp (not shown) instead of opposed U-bars 60.

As with the first tier 16, an accessory is attached to the second tier supporting member 18. In the embodiment shown in FIG. 4, the U-shaped arm system of the second tier supporting member 18 is connected to a printing head 28 or curing unit. The printing head 28 is connected to the U-shaped arm system by sliding the printing head 28 into the channels formed by the U-bars 60. The printing head 28 is then fixed in position with the use of set screws. Also, accessories other than a printing head 28, such as a curing unit or pallet 26, can be connected to the U-shaped arms 60. Further, other well-known conventional connecting means, such as cams, end clamps, etc. . . . can be employed. Additionally, the U-shaped arms 60 may be eliminated such that the accessory is directly connected to the supporting arm 18.

Each second tier supporting member 18 has a second registration system 56 located on the lower surface of the second tier supporting member 18. See FIGS. 4, 6 and 7. Similar to the first registration system 54, the second registration system 56 includes horizontal 120 and vertical 122 registration mechanisms. The horizontal registration mechanism 120 is a projection 124 extending vertically downward from, and fixed to the lower surface of the second tier supporting member 18. The vertical registration mechanism 122 is a positioning stud 126 also extending vertically downward from, and fixed to the lower surface of the second tier supporting member 18. The vertical positioning stud 126 is positioned closer to the bracket 50 of the supporting member 18 than the horizontal registration projection 124. When the second tier supporting member 18 is brought toward the first tier supporting member 14, the second registration system 56 cooperates with the first registration system 54. As shown in schematic FIG. 9, a radius R2 extends from the pivoting pin 106 to the second registration system 56. Radius R1 extends from the center of the base section 12 to the first registration system 54. The components of the second registration system 56 attached to the second tier arm 18 rotate through an arc having radius R2 to interact with the first registration system 54. Each arm 18 of the second tier 16 has the same radius R2 so that the registration assemblies 56 of each arm 18 interacts with the arms 14 of the first tier in identical fashion.

Initially, the second tier's horizontal registration projection 124 slides into the gap between the two rollers or spacers 90 of the first registration system 54. See FIG. 8. The interaction of the rollers 90 and the projection 124 aligns the second tier supporting arm 18 substantially horizontally in relation to a pallet 26 attached to the pallet supporting arm 14. As the projection 124 slides between the rollers 90, the vertical registration stud 126 of the second registration system 56 nears the positioning stop 92 of the first registration system 54 until the two elements 126,92 contact. The contact point designates the vertical registration position. At the point when the second tier printing arm 18 is vertically and horizontally registered with the pallet support member 14, the printing head 28 is positioned just above and parallel to the pallet 26. Thus, when the screen 58 is squeegeed, the paint will pas to the substrate resting on the pallet 26. Screen printing can take place at any time hereinafter.

The Third Auxiliary Tier 24

The third or auxiliary tier of support arms 22 is the third tier of radially spoking arms above the base section 12, and the highest tier of radial arms shown in FIGS. 1 and 2. Similar to the second tier 20, the third tier 24 contains four primary components: (1) a rotatable auxiliary or third collar 42; (2) a supporting member 22; (3) a second registration system 56; and, (4) an accessory, here a printing head 28. See FIG. 3. The auxiliary or third collar 42 and third tier supporting members 22 are load bearing members. As such, these members are generally made of high strength materials including steel, aluminum, or any other acceptable material having similar qualities.

Figure 3:
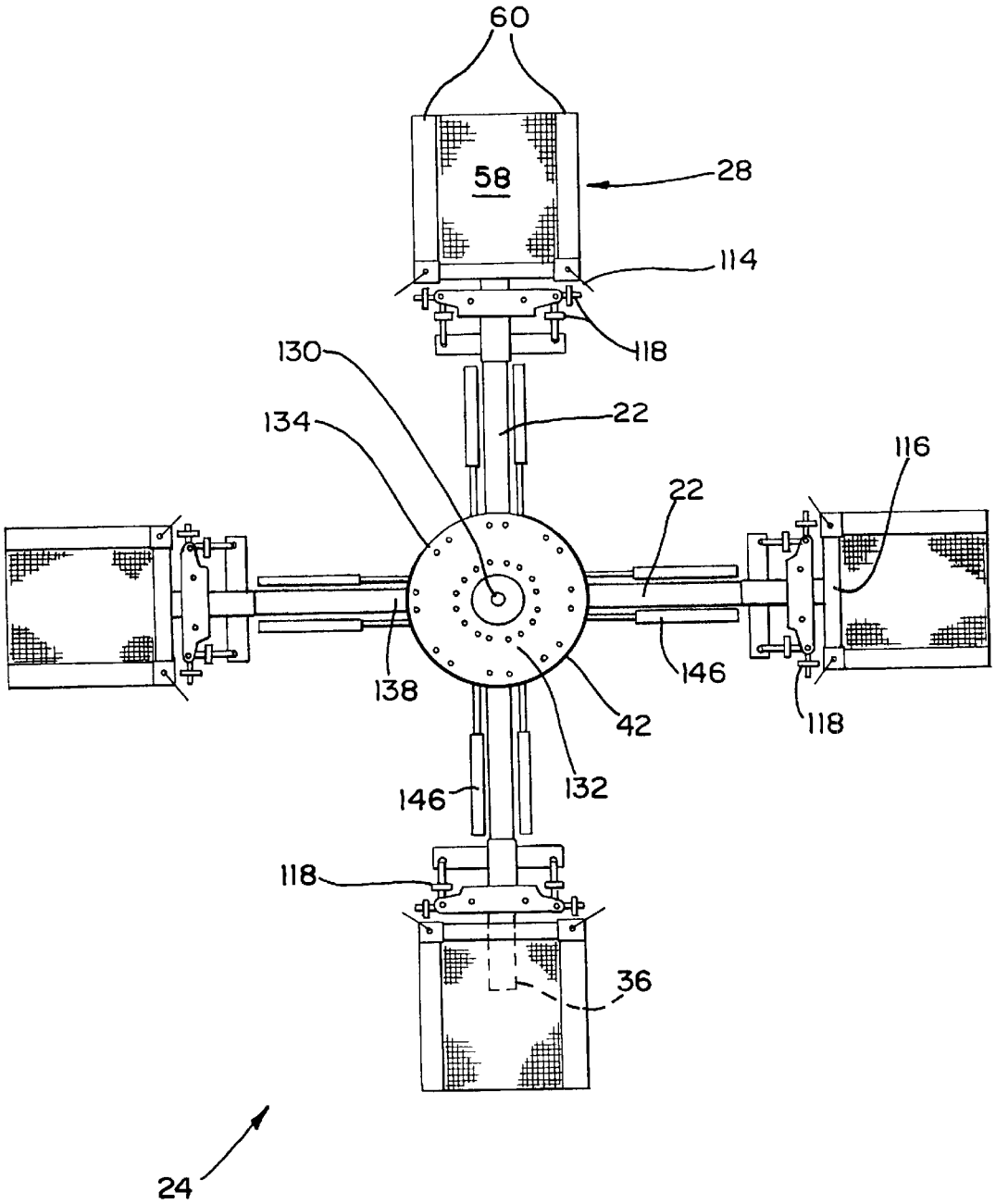
FIG. 3 is a top plan view along line 3—3 of FIG. 2, showing the third tier of the printing head supporting members.

As shown in FIG. 3, the rotatable auxiliary collar 42 includes a ring 130 and a circular plate 132. The ring 130 of the auxiliary collar 42 generally has an inner diameter and outer diameter. The inner diameter of the ring 130 contains bearing elements (not shown) which mate with the main shaft 44. The bearing elements allow the auxiliary collar 42 to independently rotate about the main shaft 44, the base section 12 and the other tiers 16,20. For placement of the auxiliary collar 42 on the main shaft 44 a bushing or thrust bearing 70 is fitted on the shaft and positioned on the top surface of the upper collar 40. Next, the auxiliary collar 42, with radial bearing elements in place, is fit onto the main shaft 44 by standard processes. As such, the bushing 70 remains between the auxiliary collar 42 and the upper collar 40. The bushing 70 acts as a frictionless surface and allows each collar 38,40,42 to rotate independently and without contacting each other. As described above, instead of, or in conjunction with the bushing 70, the main shaft 44 may be machined with multiple shoulders for seating some or all of the collars/tiers of the overall machine.

Similar to the plate 96 of the upper collar, the plate 132 of the auxiliary collar extends radially outward from the ring 130. This plate 132, however, has a much smaller diameter as shown in FIGS. 1 and 2. The plate 132 includes a series of equally spaced bolt hole patterns 134 about the edge of the plate 132. In the preferred embodiment, shown in FIG. 3, there are eight equally spaced bolt hole patterns 134, each pattern being centered every 45° proximate the edge of the plate 132.

The third tier support members 22 are attached to the auxiliary collar 42 through a bracket 52 at the first end 138 of the auxiliary support members. Contrary to the bracket 50 of the second tier, the bracket 52 of the third tier is connected to the bottom surface of the plate 132. The bracket 52 extends from the first end, or base end 138, of the auxiliary tier support member 22 and is comprised of two parallel opposing bars 142 and a pivoting pin 144 between the two bars 142. Further, each bar 142 contains a series of threaded holes on the bar's top surface. The series of threaded holes matches the bolt hole pattern 134 on the plate 132. Thus, the bracket portion 52 of the support member 22 can be bolted to the bottom surface of the plate 132 at one of the plate's bolt hole patterns 134. As shown in FIG. 3, four equally spaced support members 22 are attached to bottom surface of the plate 132. However, more than or less than four auxiliary tier support members 22 may be utilized. Generally, the auxiliary tier 24 is comprised of the same number of supporting members 14 as the first tier 16.

The auxiliary tier 24 includes means for selectively bringing an auxiliary tier printing head supporting member 22 toward a pallet supporting member 14. One means includes the bracket 52 of the supporting member 22 having a hinge or pivoting pin 144, whereby the pin 144 rotatably retains the supporting member 22. In addition to the pivoting pin rotatably 144 retaining the supporting member 22, the bracket 52 includes two pistons 146, one each side of the supporting member 22, which are connected from the bracket 52 to the supporting member 22. In the preferred embodiment the pistons 146 assist the user in more easily raising and lowering the printing head support arm 22. Pistons 146 are utilized due to the longer dimension and increased moment arm length of the auxiliary support members 22 as compared to the second tier supporting members 18. As shown in FIGS. 6 and 8, the auxiliary support member 22 vertically rotates about the pin 144 relative to first tier supporting arms 14, between a raised position and a lowered position. In the raised position a stop 148 in the bracket 52 prevents the supporting arm 22 from being rotated any further upward than shown in FIGS. 1, 3, 6 and 7. In the lowest rotation position, the printing head 28 connected to the auxiliary tier printing head supporting member 22 is able to contact a substrate on a pallet 26 of the first tier 16. Screen printing takes place at this lower point.

As shown in FIG. 3, the distal end 36 of the support member has a U-shaped arm system which ultimately supports an accessory, similar to the supporting arm of the second tier 18. The U-shaped arm system consists of two lateral L-bars or U-bars 60 connected to horizontal member 116. A slidable clamp 114 connecting each U-bar 60 to the horizontal member 116 allows each U-bar 60 to be independently moved in and out from the centerline of the supporting arm 22. Additionally, a series of clamps 118 manipulate the overall U-shaped arm system relative to the supporting arm 18 in order to correctly align the U-shaped arms 60 and an inserted accessory with a mating substrate.

As with the second tier 20, an accessory is attached to the auxiliary tier supporting member 22. In the embodiment shown in FIG. 3, the U-shaped arms 60 of the auxiliary tier supporting member 22 is optionally connected to a printing head 28. Accessories other than a printing head 28, such as a curing unit, can be connected to the U-shaped arms 60. Additionally, other well-known conventional connectors may be employed, or the U-shaped arms 60 may be eliminated such that the accessory is directly connected to the supporting arm 22.

Each auxiliary tier supporting member 22 has a second registration system 56 located on the lower surface of the auxiliary tier supporting member 22. See FIGS. 3, 6 and 7. This registration system 56 is identical to the registration system 56 on the second tier supporting members 18. As such, the second registration system 56 herein includes horizontal 120 and vertical registration mechanisms 122. The horizontal registration mechanism 120 is comprised of a projection 124 extending vertically downward from, and fixed to the lower surface of the auxiliary tier supporting member 22. The vertical registration mechanism 122 is comprised of a positioning stud 126 also extending vertically downward from, and fixed to the lower surface of the auxiliary tier supporting member 22. The vertical positioning stud 126 is positioned closer to the hinge 52 on the supporting member 22 than the horizontal registration projection 124. As shown in schematic FIG. 9, a radius R3 extends from the pivoting pin 144 to the second registration system 56. Radius R1 extends from the center of the base section 12 to the first registration system 54. The components of the second registration system 56 attached to the third tier arm 22 rotate through an arc having radius R3 to interact with the first registration system 54. Each arm 22 of the third tier 24 has the same radius R3 so that the registration assemblies 56 of each arm 22 interacts with the arms 14 of the first tier in identical fashion. When the auxiliary tier supporting member 22 is brought toward the first tier supporting member 14, the second registration system 56 cooperates with the first registration system 54. At the point when the auxiliary tier printing head 22 is vertically and horizontally registered with the pallet support member 14, the printing head 28 nearly touches the substrate resting on the pallet.

Finally, an optional gap can be introduced to the third tier 24 in the same manner as above described relating to the second tier 20. This third tier gap permits open maneuverability of the second tier arms 18. For example, when one is moving a second tier arm 18 vertically, the gap in the third tier (aligned above the moving second tier arm 18) permits easier access by the operator. In short, a third tier gap gives an operator additional headroom to maneuver.

While the specific embodiments have been illustrated and described, numerous modifications are possible without significantly departing from the spirit of the invention, and the scope of protection is only limited by the scope of the accompanying claims.

We claim:

1. A printing machine comprising:

a first tier of pallet supporting members, each supporting a pallet and each having a first registration assembly associated therewith;

a second tier of printing head supporting members, the second tier above the first tier, at least one of the second tier printing head supporting members supporting a printing head, and each having a second registration assembly associated therewith;

a third tier of printing head supporting members, the third tier above the second tier, at least one of the third tier printing head supporting members supporting a printing head, and each having a second registration assembly associated therewith; and, means for selectively bringing either a second tier printing head supporting member or a third tier printing head supporting member toward a pallet supporting member and the first and second registration assemblies cooperating with one another when a printing head is brought into close proximity to a pallet.

2. The printing machine as defined in claim 1 wherein:

each first tier supporting member is connected at one end to a rotatable lower collar and optionally connected at the other, distal end to a pallet;

each second tier supporting member is connected at one end to a rotatable upper collar and optionally connected at the other, distal end to a printing head; and, each third tier supporting member is connected at one end to a rotatable auxiliary collar and optionally connected at the other, distal end to a printing head, and the lower collar, the upper collar, and the auxiliary collar being rotatably mounted to the base section for permitting all of the tiers of supporting members to rotate about the base section.

3. The printing machine of claim 1 wherein the first registration assembly includes a first horizontal and first vertical registration mechanism, the first horizontal registration mechanism having spacers connected to the supporting member, the spacers spaced apart by a gap, and the first vertical registration mechanism having a positioning stop attached to the supporting member.

4. The printing machine of claim 1 wherein the second registration assembly includes a second horizontal and second vertical registration mechanism, the second horizontal and second vertical registration mechanisms having projections extending vertically downward from a lower surface of the supporting members.

5. The printing machine of claim 1 wherein the means for bringing a printing head supporting member toward a pallet supporting member is a hinge disposed generally between the printing head supporting member and a collar.

6. The printing machine of claim 1 wherein both the second tier and third tier printing head supporting members are moveable in at least two radial planes, normal to one another, the first plane being a horizontal plane and the second plane being a vertical plane.

7. A turret style printing machine having a lower set of radial arms supporting pallets and an upper set of radial arms supporting printing heads, the upper and lower radial arms cooperating with one another during the printing process for permitting the printing heads to cooperate with substrates on the pallets, comprising:

an auxiliary set of arms also supporting printing heads positioned above the set of upper radial arms for cooperating with the lower radial arms during the printing process wherein at least one of the printing heads generally cooperates with a substrate on at least one of the pallets; and, each upper radial arm and each auxiliary radial arm has a second registration assembly thereon for selectively engaging a first registration assembly on each lower radial arm during the printing process.

8. The printing machine as defined in claim 7 wherein the upper and auxiliary sets of radial arms rotate about a base section.

9. The printing machine as defined in claim 7 wherein all of the sets of radial arms rotate about a base section.

10. The printing machine as defined in claim 7 wherein:

each upper radial arm is connected at one end to a rotatable upper collar and optionally connected at the other, distal end to a printing head;

each auxiliary radial arm is connected at one end to a rotatable auxiliary collar and optionally connected at the other, distal end to a printing head;

each lower radial arm is connected at one end to a rotatable lower collar and optionally connected at the other, distal end to a pallet; and, the upper collar, the auxiliary collar and the lower collar being rotatably mounted to the base section for permitting all of the sets of radial arms to rotate about the base section.

11. The printing machine of claim 7 wherein the first registration assembly includes a first horizontal and first vertical registration mechanism, the first horizontal registration mechanism having rollers connected to the supporting member, the rollers spaced apart by a gap, and the first vertical registration mechanism having a positioning stop attached to the supporting member.

12. The printing machine of claim 7 wherein the second registration assembly includes a second horizontal and second vertical registration mechanism, the second horizontal and second vertical registration mechanisms having projections extending vertically downward from a lower surface of the supporting members.

13. A printing machine comprising:

a centrally located base section;

a plurality of pallet supporting radial arms projecting and spoking outwardly from the base section;

a plurality of printing head supporting radial arms projecting and spoking outwardly from the base section above the pallet supporting radial arms;

at least one auxiliary printing head supporting radial arm projecting and spoking outwardly from the base section above the printing head supporting radial arms;

a first registration assembly supported by each printing head supporting arm and auxiliary printing head supporting arm; and, a second registration assembly supported by each pallet supporting arm for mating with the first registration assembly during the printing process.

14. The printing machine as defined in claim 13 wherein:

the printing head supporting arms are adapted for movement relative to and alignment with the pallet supporting arms to permit a printing head attached to a distal end of at least one printing head supporting arm to cooperate with a substrate resting on a pallet attached to a distal end of the pallet supporting arm; and, the auxiliary printing head supporting arms are also adapted for movement relative to and alignment with the pallet supporting arms to permit a printing head attached to a distal end of at least one auxiliary printing head supporting arm to cooperate with a substrate resting on a pallet attached to a distal end of the pallet supporting arm.

15. The printing machine as defined in claim 13 wherein both the printing head supporting arms and the auxiliary printing head supporting arms are moveable in at least two radial planes, normal to one another.

16. The printing machine as defined in claim 13 wherein:

the printing head supporting arms are moveable in both a) a horizontal plane about the base section by a rotatable collar connected to each arm at or adjacent an end of the arm opposite the distal end thereof and b) a vertical plane about the base section by a hinge disposed on the arm between the distal end and the opposite end of the arm;

the auxiliary printing head supporting arms are moveable in both a) a horizontal plane about the base section by an auxiliary collar connected to each arm at or adjacent an end of the arm opposite the distal end thereof and b) a vertical plane about the base section by a hinge disposed on the arm between the distal end and the opposite end of the arm; and, the printing head attached to the auxiliary printing head supporting arm is able to cooperate with a substrate resting on a pallet attached to the pallet supporting arm by aligning the auxiliary printing head supporting arm with a pallet supporting arm and moving the auxiliary printing head supporting arm substantially vertically between the printing head supporting arms to the pallet attached to the pallet supporting arm.

17. The printing machine of claim 13 wherein the first registration assembly includes a first horizontal and first vertical registration mechanism, the first horizontal registration mechanism having spacers connected to the supporting member, the spacers spaced apart by a gap, and the first vertical registration mechanism having a positioning stop attached to the supporting member.

18. The printing machine of claim 13 wherein the second registration assembly includes a second horizontal and second vertical registration mechanism, the second horizontal and second vertical registration mechanisms having projections extending vertically downward from a lower surface of the supporting members.

19. A printing machine comprising:

a centrally located base section;

N equally spaced apart pallet supporting arms spoking outwardly from the base section;

at most N−1 printing head supporting arms and a gap spoking outwardly from the base section above the pallet supporting arms, the gap together with the printing head supporting arms being equally spaced apart; and, at least two auxiliary printing head supporting arms spoking outwardly from the base section above the printing head supporting arms.

20. The printing machine as defined in claim 19 wherein each arm has a base end connected proximate thereof to a collar rotatable relative to the base section and a distal end optionally connected to a pallet or a printing head, the rotation of a collar permitting rotation in the horizontal plane of the connected arm.

21. The printing machine as defined in claim 19 wherein each printing head supporting arm has a pivoting hinge disposed between the base end and the distal end for permitting rotation in the vertical plane of the connected distal end of the arm.

22. The printing machine as defined in claim 19 wherein the pallet supporting arms are connected to a first collar, the printing head supporting arms are connected to a second collar and the auxiliary printing head supporting arms are connected to a third collar, each collar rotatable independent of the other collars.

23. The printing machine as defined in claim 19 wherein:

each printing head supporting arm is adapted for a) rotating to an aligned position wherein a printing head supported by the printing head supporting arm is substantially above a pallet with a substrate thereon supported by a pallet supporting arm and b) pivoting the printing head supported by the printing head supporting arm to cooperate with the substrate on the pallet supported by the pallet supporting arm; and, each auxiliary printing head supporting arm is adapted for a) rotating to an aligned position wherein the auxiliary printing head supported by the auxiliary printing head supporting arm is substantially above a pallet with a substrate thereon supported by a pallet supporting arm and b) pivoting the auxiliary printing head supported by the auxiliary printing head supporting arm to cooperate with the substrate on the pallet supported by the pallet supporting arm.

24. The printing machine as defined in claim 19 wherein the auxiliary printing head and auxiliary printing head supporting arm are passed through the gap when the auxiliary printing head is pivoted to cooperate with the substrate on the pallet supported by the pallet supporting arm.

25. A printing machine comprising:

a centrally located base section;

N radially and equally spaced apart pallet supporting arms spoking outwardly from the base section with each being adapted to optionally support a pallet proximate a distal end thereof;

at most N−1 radially spaced apart printing head supporting arms spoking outwardly from the base section above the pallet supporting arms with each being adapted to optionally support a printing head proximate a distal end thereof; and, N radially and equally spaced apart auxiliary printing head supporting arms spoking outwardly from the base section above the printing head supporting arms with each being adapted to optionally support an auxiliary printing head proximate a distal end thereof.

26. The printing machine as defined in claim 25 wherein an operator can selectively mate a pallet with one of either a printing head or an auxiliary printing head.

27. The printing machine as defined in claim 25 wherein each arm is rotatable in both the horizontal and vertical directions.

28. The printing machine as defined in claim 24 wherein each arm has a base end connected proximate thereof to a collar rotatable relative to the base section permitting rotation in the horizontal plane of the connected arm and each arm has a pivoting hinge disposed generally between the base end and the distal end for permitting rotation in the vertical plane of the connected distal end of the arm.

29. The printing machine as defined in claim 25 wherein the pallet supporting arms are connected to a first collar, the printing head supporting arms are connected to a second collar and the auxiliary printing head supporting arms are connected to a third collar, each collar moveable independent of the other collars.

30. The printing machine as defined in claim 25 wherein each first tier pallet supporting member has a first registration assembly associated therewith and each second and third tier printing head supporting members has a second registration assembly associated therewith, the first and second registration assemblies cooperating with one another when a printing head is brought into close proximity with a pallet.

31. The printing machine of claim 30 wherein the first registration assembly includes a first horizontal and first vertical registration mechanism, the first horizontal registration mechanism having rollers connected to the supporting member, the rollers spaced apart by a gap, and the first vertical registration mechanism having a positioning stop attached to the supporting member.

32. The printing machine of claim 21 wherein the second registration assembly includes a second horizontal and second vertical registration mechanism, the second horizontal and second vertical registration mechanisms having projections extending vertically downward from a lower surface of the supporting members.

* * * * *

UNITED STATES PATENT AND TRADEMARK OFFICE

CERTIFICATE OF CORRECTION

PATENT NO. : 5,845,569 
DATED : December 8, 1998
INVENTOR(S) : Darius Tkacz, Alex Iaccino and Allen Mark Repashy It is certified that error appears in the above-identified patent and that said Letters Patent is hereby corrected as shown below:

Column 18,
Line 7, please delete "claim 24" and insert therefor -- claim 25 --.
Line 34, please delete "claim 21" and insert therefor -- claim 30 --.

Signed and Sealed this

Eleventh Day of November, 2003

JAMES E. ROGAN
*Director of the United States Patent and Trademark Office*